US006024812A

United States Patent [19]

Bley et al.

[11] Patent Number: 6,024,812

[45] Date of Patent: Feb. 15, 2000

[54] PYROTECHNIC MIXTURE AS PROPELLANT OR A GAS CHARGE WITH CARBON MONOXIDE-REDUCED VAPORS

[75] Inventors: Ulrich Bley, Fuerth; Klaus Redecker, Nuernberg, both of Germany

[73] Assignee: Dynamit Nobel GmbH Explosivstoff-und Systemtechnik, Torisdorf, Germany

[21] Appl. No.: 09/254,941

[22] PCT Filed: Jul. 17, 1997

[86] PCT No.: PCT/EP97/03835

§ 371 Date: Mar. 17, 1999

§ 102(e) Date: Mar. 17, 1999

[87] PCT Pub. No.: WO98/03449

PCT Pub. Date: Jan. 29, 1998

[30] Foreign Application Priority Data

Jul. 20, 1996 [DE] Germany ..... 196 29 226

[51] Int. Cl.[7] ..... C06B 25/34; C06B 31/28; C06B 29/22

[52] U.S. Cl. ..... 149/92; 149/46; 149/76

[58] Field of Search ..... 149/46, 47, 76, 149/92, 109.6; 102/289

[56] References Cited

U.S. PATENT DOCUMENTS

| | | | |
|---|---|---|---|
| 3,677,841 | 7/1972 | Ayres et al. | 149/92 |
| 5,125,684 | 6/1992 | Cartwright | 280/736 |
| 5,386,775 | 2/1995 | Poole et al. | 102/289 |
| 5,482,579 | 1/1996 | Ochi et al. | 149/83 |
| 5,531,941 | 7/1996 | Poole | 264/3.4 |
| 5,756,929 | 5/1998 | Lundstrom et al. | 149/22 |

*Primary Examiner*—Charles T. Jordan
*Assistant Examiner*—Aileen J. Baker
*Attorney, Agent, or Firm*—Antonelli, Terry, Stout & Kraus, LLP

[57] ABSTRACT

The invention pertains to propellants that have a substantially reduced CO concentration in the gas vapors compared to NC propellants. These propellants contain nitroaminoguanidines as main component, explosives as additives and oxidising agents.

15 Claims, No Drawings

PYROTECHNIC MIXTURE AS PROPELLANT OR A GAS CHARGE WITH CARBON MONOXIDE-REDUCED VAPORS

The subject matter of the invention is a pyrotechnic mixture as propellant or as a gas charge with carbon monoxide-reduced combustion vapours.

Propellants based on nitrocellulose (NC) are used in the most varied applications, for example in civil ammunition and military ammunition or as a gas-generating component in industrial cartridges, for example in bolt-firing tools. NC propellants are distinguished by their high degree of distribution, their favourable price as a result thereof and great extent of experience in handling and use, as well as a high level of variability of the combustion characteristics which can be controlled by way of the composition, the geometric form and surface treatment. Due to their almost slag-free burn-off, NC propellants supply a high amount of gas. These gas vapours contain as main component (40–60% by volume) toxic carbon monoxide (CO). For this reason, when using NC propellants, above all in closed areas, good ventilation or limited use must be ensured.

For this reason, the aim of numerous developments and inventions has been to provide CO-reduced propellants or pyrotechnic mixtures. Propellants or pyrotechnic mixtures with reduced CO-content are much described in literature, for example as gas-generating mixtures, as are used, among other things, in air bags. These mixtures are combinations of nitrogen-rich compounds, for example sodium azide or 5-aminotetrazole and suitable oxidizing agents such as sodium nitrate or potassium perchlorate. These mixtures burn with the formation of a large amount of slag. For this reason, and because of their combustion characteristics, they are not suitable, for example, for use in ammunition.

Due to the specific requirements for ammunition and other related applications, mixtures must therefore be found with components which, in addition to the suitable combustion characteristics, also have a low carbon portion. Propellants which contain nitroaminoguanidine (NAGu) are suitable and fulfil this requirement. Nitroaminoguanidine is a nitrogen-rich molecule with explosive characteristics.

In U.S. Pat. No. 4,373,976 a mixture with NAGu as main component (50–80% by weight) is described. In this respect, NAGu is used in combination with NC (15–40% by weight), octogen (0–30% by weight) and binders such as triacetin (0–15% by weight). This propellant should be distinguished by an isochoric flame temperature which is reduced by 20–30% compared with conventional propellants and should be suitable for use in ammunition. However, because of the high portions of NC, octogen and binders, the CO constituent in the gas vapours may not be reduced.

In U.S. Pat. No. 3,677,841, the use of NAGu in combination with combustion catalysts, for example vanadylacetylacetonate, in addition to other compounds, is described. The mixtures should be suitable for use in gas producers as gas generators. However, by using heavy-metal catalysts, a heavy-metal-containing slag which is toxic is produced during combustion.

An object of the present invention was therefore to provide propellants which do not have the disadvantages of the propellants which are known in the prior art.

The object of the invention was achieved with a propellant having the characterizing part of the main claim. Preferred developments are characterized in the subclaims.

The propellants in accordance with the invention are distinguished in that they have a CO concentration in the gas vapours which is clearly reduced compared with NC propellants. The propellants in accordance with the invention are distinguished, furthermore, by an almost slag-free combustion. The CO constituent in the gas vapours is reduced by more than 50% compared with NC propellants. In contrast with NC propellants, with the propellants in accordance with the invention nitrogen (about 40–50% by volume) and water (about 20–30% by volume) arise in the gas vapours as main components. The combustion characteristics and characteristic safety data of the mixtures in accordance with the invention are comparable with those of typical NC propellants.

The propellants in accordance with the invention contain, as the main component, nitroaminoguanidine, in parts by weight of 40–80% by weight. Suitable additional charges are explosives such as nitroguanidine, derivatives of tetrazole such as 5-aminotetrazole, 5-aminotetrazole nitrate, bistetrazole amine, bitetrazole and their salts with the elements of the I, II and III main group and I, II and VIII subgroup of the periodic system as well as salts of titanium and manganese, salts of nitraminotetrazolate such as ammonium nitraminotetrazolate and aminoguanidinium nitraminotetrazolate, aminoguanidine nitrate, diaminoguanidine nitrate, triaminoguanidine nitrate, guanidine nitrate, dicyandiamidine nitrate, diaminoguanidine azotetrazolate, hexogen, octogen and nitrocellulose.

Nitroguanidine, triaminoguanidine nitrate, aminotetrazole, hexogen and nitrocellulose as well as mixtures of the components with each other are preferably used. The parts by weight of the additional explosive charges can amount to 0 to 40% by weight.

Further additions are binding agents such as polyvinyl butyral, polynitropolyphenylene, triacetin, gelatin and glue. Polyvinyl butyral in parts by weight of 0 to 10% by weight are preferably used.

Nitrates of alkali and alkaline earth elements, perchlorates of alkali and alkaline earth elements, ammonium nitrate, ammonium perchlorate or mixtures of these components can be used as oxidizing agents. Ammonium nitrate and ammonium perchlorate in parts by weight of 0 to 30% by weight are preferably used.

Ferrocene and derivates, acetylacetonate and derivatives, Aerosil, graphite, talc or mixtures of these components can be used as combustion moderators and processing aids. The parts by weight can be 0 to 10% by weight.

The manufacture and processing takes place according to usual methods which are known in themselves. Among them are, for example, kneading, extrusion moulding, extruding, granulating or tabletting.

The pyrotechnic mixtures in accordance with the invention are for use in civil and military ammunition, as a gas-generating component in industrial cartridges, for example in bolt-firing tools and are suitable as propellants for gas generation in motor vehicle safety systems, for example safety-belt tighteners or air bags.

By means of geometric variations and additions, the combustion characteristics can be set to be similar to the NC propellants. NC propellants can be characterized typically by way of their characteristic safety data and the combustion rate. Thus, typical data of NC propellants are:

sensitivity to friction: 160–240 N, sensitivity to impact: 2–5 J, detonation point: 160–170° C.

explosion heat: 4000–5000 J/g.

The combustion rates are pressure-dependent and are typically about 10–20 mm/s at 100 bar and about 50–70 mm/s at 500 bar.

The components of the pyrotechnic mixture in accordance with the invention can tolerate each other well (gas evolution of selected mixtures at 90° C. and 40h <<3 ml). Thermogravimetric investigations show decompositions from 180° C. and with isothermal storage (90° C.) weight changes <0.5% by weight with 48 hours storage time.

The following examples should explain the invention in more detail, without restricting it.

These examples show that the mixtures in accordance with the invention are comparable with NC propellants with respect to their combustion characteristics and characteristic safety data, although they have clearly lower CO concentrations in the combustion vapours.

Table 1 shows the composition of 5 different pyrotechnic mixtures in accordance with the invention. The specified components for the mixtures in accordance with the invention are weighed in the indicated weight ratios in plastic containers and are homogenized for 30 minutes in a dry-blend mixer.

Table 2 shows the sensitivities to friction and impact, detonation points and explosion heat. The measurement of the sensitivities to friction and impact took place according to methods of the Bundesanstalt für Materialforschung und -prüfung (BAM) [Federal Institute of Material Research and Testing]. The detonation points were determined by means of thermal gravimetric analysis (Mettler) and the measurement of the explosion heat took place with a calorimeter of the firm EKA.

For the measurement of the CO concentration, defined quantities (2 g) of the mixtures were brought to reaction in a 25 ml high-grade steel pressure bomb by means of ignition via incandescent filament. Subsequently, the gas produced was put into a Tedlar bag and the composition and CO concentration of the gas mixture were determined with a gas chromatograph (FISON). The results are shown in Table 3.

The determination of the combustion rate took place by tabletting the mixtures to form tablets with a height of about 2.5 mm and a diameter of 7 mm. 2 g of the tabletted samples were brought to reaction in a 25 ml high-grade steel pressure bomb by means of 0.2 g boron/potassium nitrate (25:75 parts by weight) as ignition mixture and an electrically heatable iron wire. The pressure development was recorded in dependence upon the time. The combustion rates (r) in dependence upon the pressure can be calculated from the pressure-time curve and the shape function. For better clarity, Table 3 shows the combustion rates at 100 and 500 bar.

Characteristic variables such as flame temperature and specific energy can be read off from thermodynamic calculations. For NC powder, typical magnitudes for the flame temperature are 2800–3600 K and specific energies of 1100–1200 J/g. In Table 4 these magnitudes are indicated for the mixture examples. The flame temperatures are clearly reduced, whereas the specific energies are comparable with those of NC propellants.

TABLE 1

Examples of propellants in accordance with the invention

| example no. | nitramino-guanidine [% by weight] | nitro-guanidine [% by weight] | hexogen [% by weight] | amino-tetrazole [% by weight] | triamino-guanidine-nitrate [% by weight] |
|---|---|---|---|---|---|
| 1 | 60 | 25 | 5 | | 10 |
| 2 | 50 | 25 | 5 | 5 | 15 |
| 3 | 70 | 20 | | | 10 |
| 4 | 60 | 30 | | | 10 |
| 5 | 70 | 30 | | | |

TABLE 2

Classification of the safety data

| example no. | sensitivity to friction [N] | sensitivity to impact [J] | detonation point [° C.] | explosion heat [J/g] |
|---|---|---|---|---|
| 1 | 240 | 3 | 185 | 3690 |
| 2 | 160 | 3 | 185 | 3619 |
| 3 | 160 | 3 | 185 | 3720 |
| 4 | 240 | 4 | 185 | 3652 |
| 5 | 240 | 3 | 185 | 3582 |

TABLE 3

Summary of the CO concentrations and combustion rates (r)

| example no. | CO concentration [% by vol.] | combustion rate 100 bar [mm/s] | combustion rate 500 bar [mm/s] |
|---|---|---|---|
| 1 | 18.4 | 16 | 90 |
| 2 | 20.1 | 15 | 92 |
| 3 | 16.9 | 21 | 104 |
| 4 | 17.6 | 16 | 96 |
| 5 | 17.4 | 16 | 89 |

TABLE 4

Classification of thermodynamically calculated variables

| mixture no. | flame temperature [K.] | specific energy [J] |
|---|---|---|
| 1 | 2751 | 1135 |
| 2 | 2605 | 1088 |
| 3 | 2700 | 1128 |
| 4 | 2666 | 1108 |
| 5 | 2680 | 1106 |

I claim:

1. Propellant with carbon monoxide-reduced vapours, characterized in that it contains as main component nitroaminoguanidine, explosives as additional charges and oxidizing agents.

2. Propellant according to claim 1, characterized in that it contains as additional charges at least one explosive selected from the explosives nitroguanidine, derivatives of tetrazole, preferably 5-aminotetrazole, 5-aminotetrazole nitrate, bistetrazole amine, bitetrazole or their salts with elements of the I, II and III main group or I, II and VIII subgroup of the periodic system or their titanium or manganese salts, the salts of nitraminotetrazolate, preferably ammonium nitraminotetrazolate or aminoguanidinium nitraminotetrazolate, aminoguanidine nitrate, diaminoguanidine nitrate, triaminoguanidine nitrate, guanidine nitrate, dicyandiamidine nitrate, diaminoguanidine-azotetrazolate, hexogen, octogen or nitrocellulose.

3. Propellant according to claim 1, characterized in that it contains as additional charges at least one explosive selected from the explosives nitroguanidine, triaminoguanidine nitrate, aminotetrazole, hexogen and nitrocellulose.

4. Propellant according to claim 1, characterized in that it contains nitroaminoguanidine in parts by weight of 40–80% by weight and the additional charges in parts by weight of 0 to 40% by weight.

5. Propellant according to claim 1, characterized in that it additionally contains binding agents such as polyvinyl butyral, polynitropolyphenylene, triacetin, gelatin or glue, preferably polyvinyl butyral.

6. Propellant according to claim 5, characterized in that it contains the binding agent in parts by weight of 0 to 10% by weight.

7. Propellant according to claim 1, characterized in that it contains as oxidizing agent nitrates of alkali or alkaline earth elements, perchlorates of the alkali or alkaline earth elements, ammonium nitrate, ammonium perchlorate, preferably ammonium nitrate or ammonium perchlorate or mixtures of these components.

8. Propellant according to claim 1, characterized in that it contains the oxidizing agent in parts by weight of 0 to 30% by weight.

9. Propellant according to claim 1, characterized in that it additionally contains combustion moderators and/or processing aids.

10. Propellant according to claim 9, characterized in that it contains, as combustion moderators and/or processing aids, ferrocene or thereof derivatives thereof, acetylacetonate or derivatives thereof, Aerosil, graphite, talc or mixtures of these components.

11. Propellant according to claim 9, characterized in that it contains combustion moderators and/or processing aids in parts by weight of 0 to 10% by weight.

12. Method for producing the propellants according to claim 1, characterized in that the components are mixed and are shaped by kneading, extrusion-moulding, extruding, granulating or tabletting.

13. In ammunition, the improvement comprising the propellant according to claim 1.

14. In industrial cartridges, the improvement comprising a gas generating component comprising the propellant according to claim 1.

15. In a motor vehicle safety system, the improvement comprising a gas generator comprising the propellant according to claim 1.

* * * * *